US009180950B1

(12) United States Patent
Davenport et al.

(10) Patent No.: US 9,180,950 B1
(45) Date of Patent: Nov. 10, 2015

(54) OUTBOARD ENGINE AND AIR INTAKE SYSTEM

(71) Applicant: BRP US INC., Sturtevant, WI (US)

(72) Inventors: Mike Davenport, Pleasant Prairie, WI (US); Dale Wiegele, Kenosha, WI (US); John Charles Scott, Lake Villa, IL (US); Paul Westhoff, Jr., Kenosha, WI (US); Jonathan Servais, Sturtevant, WI (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 13/907,458

(22) Filed: May 31, 2013

(51) Int. Cl.
*F02M 35/04* (2006.01)
*B63H 21/36* (2006.01)
*B63H 20/00* (2006.01)

(52) U.S. Cl.
CPC ..... *B63H 20/001* (2013.01)

(58) Field of Classification Search
CPC ... F02M 35/168; F02M 35/167; B63H 21/36; B63H 20/32
USPC ..... 440/77, 88 A
See application file for complete search history.

(56) References Cited

U.S. PATENT DOCUMENTS 3,610,198 A 10/1971 Alexandrowicz
4,723,927 A 2/1988 Walsh et al.
4,734,070 A 3/1988 Mondek
4,968,276 A 11/1990 Hashimoto
4,978,321 A 12/1990 Ferguson
5,133,307 A 7/1992 Kurihara
5,391,099 A 2/1995 Allain
5,445,547 A 8/1995 Furukawa
7,572,159 B2 * 8/2009 Ide et al. ..... 440/88 A
8,651,906 B1 * 2/2014 Morton ..... 440/77
2007/0093152 A1 * 4/2007 Ochiai et al. ..... 440/88 A
2012/0214370 A1 8/2012 Watanabe

OTHER PUBLICATIONS

BRP Parts Catalogs; model 1997 Evinrude BE225CXEUD; retrieved from http://epc.brp.com/Index.aspx?lang=E&s1=3af94e78-4b65-4143-bd3f-e4a1fe56b54a&brands=ej&dealerlocator=no on Jan. 9, 2015.

* cited by examiner

*Primary Examiner* — S. Joseph Morano
*Assistant Examiner* — Andrew Polay
(74) *Attorney, Agent, or Firm* — BCF LLP

(57) ABSTRACT

A cowling for housing an outboard engine. The cowling includes a plurality of walls defining at least in part an engine compartment. An engine compartment inlet, in fluid communication with the engine compartment, is defined at least in part by at least one of the plurality of walls. A hydrophobic mesh member disposed across the inlet is adapted to prevent at least a portion of a water content of an airflow flowing to the engine compartment via the engine compartment inlet from entering the engine compartment. An outboard engine having the cowling is also disclosed.

21 Claims, 11 Drawing Sheets

OUTBOARD ENGINE AND AIR INTAKE SYSTEM

FIELD OF THE INVENTION

The present invention relates to outboard engines and more specifically, to air intake systems for outboard engines.

BACKGROUND

An outboard engine includes an internal combustion engine and a cowling covering the engine and other components of the power head so as to prevent them from being damaged by water, salt, wind and other such exterior elements. The combustion process of the engine is enabled by drawing air from outside the cowling into the engine housed inside the cowling. This air drawn from outside is often mixed with a significant amount of water which needs to be removed before air enters the combustion chambers. The wet air drawn in from the exterior of the cowling is often forced to flow along a circuitous path ("labyrinth" or "chicane" for example) having one or more direction changes in order to remove water from the air.

Air travelling along circuitous and long paths in the engine compartment remains in contact for a longer time with components of the power head which are typically hot during operation of the engine. Thus, air entering the combustion chamber after flowing along a long circuitous path inside the engine compartment, although relatively free from water, may be relatively hot compared to air outside the engine compartment. As such, the circuitous airflow path has the undesirable effect of heating the air flowing into the combustion chamber, which could reduce the power output by the engine.

It is thus desirable to provide an air intake system for an outboard engine that does not cause a large increase in air temperature while still reducing the water content of the air.

SUMMARY

It is an object of the present invention to ameliorate at least some of the inconveniences present in the prior art.

In one aspect, the present provides a cowling for housing an outboard engine. The cowling includes a plurality of walls defining at least in part an engine compartment. An engine compartment inlet, in fluid communication with the engine compartment, is defined at least in part by at least one of the plurality of walls. A hydrophobic mesh member is disposed across the inlet. The mesh member is adapted to prevent at least a portion of a water content of an airflow to the engine compartment flowing via the engine compartment inlet from entering the engine compartment.

In another aspect, the engine compartment inlet is disposed in one of the plurality of walls of an upper portion of the cowling.

In yet another aspect, the engine compartment inlet is disposed in one of the plurality of walls of a rear portion of the cowling.

In an additional aspect, the engine compartment inlet is a first engine compartment inlet and the airflow is a first airflow. A second engine compartment inlet is in fluid communication with the engine compartment and defined at least in part by at least one of the plurality of walls. A passage fluidly communicates with the second engine compartment inlet and thereby with the engine compartment. The passage is defined at least in part by at least one of the plurality of walls. The passage is adapted to conduct a second airflow toward the second engine compartment inlet from the passage, the second airflow flowing through the second engine compartment inlet to the engine compartment. The passage is adapted to conduct the second airflow into the engine compartment via a circuitous path having at least one bend to cause a reduction in a water content of the second airflow.

In a further aspect, at least a portion of the passage extends generally downwardly towards the second engine compartment inlet.

In an additional aspect, a baffle is connected to at least one of the plurality of walls, the passage being defined at least in part by the baffle.

In another aspect, the second engine compartment inlet is defined at least in part by the baffle.

In another aspect, the first engine compartment inlet is defined at least in part by the baffle.

In yet another aspect, a portion of the baffle extends downwardly from the mesh member and the first engine compartment inlet.

In a further aspect, a main inlet is defined at least in part by at least one of the plurality of walls. The at least one of the plurality of walls is an outer wall. The main inlet fluidly communicates with the first inlet and the passage.

In another aspect, the plurality of walls includes a rear cover and a top cover extending forward of the rear cover. The main inlet is defined between the rear cover and the top cover.

In another aspect, an outboard engine includes an engine having at least one cylinder, a combustion chamber defined by the at least one cylinder, and a throttle body having a throttle body inlet fluidly connected to the combustion chamber. A cowling has a plurality of walls defining at least partly an engine compartment housing at least a portion of the engine. The cowling includes an engine compartment inlet defined at least in part by at least one of the plurality of walls. A passage fluidly communicates the engine compartment inlet with the combustion chamber and is defined at least in part by at least one of plurality of walls. A hydrophobic mesh member is disposed in one of the inlet and the passage. The mesh member is adapted to prevent at least a portion of a water content of an airflow to the engine compartment via the engine compartment inlet from entering the engine compartment.

In a further aspect, the hydrophobic mesh member is disposed in the engine compartment inlet.

In an additional aspect, the passage fluidly communicates the engine compartment inlet with the throttle body inlet.

In another aspect, the engine compartment inlet is at a level that is either higher than or equal to a level of the throttle body inlet.

In another aspect, at least a portion of the passage is disposed between the engine and an upper portion of the cowling.

In yet another aspect, the engine compartment inlet is a first engine compartment inlet, the passage is a first passage, and the airflow is a first airflow. A second engine compartment inlet is defined at least in part by at least one of plurality of walls. A second passage fluidly communicates with the second engine compartment inlet and is defined at least in part by at least one of plurality of walls. The second passage is adapted to conduct a second airflow toward the second engine compartment inlet from the second passage. The second passage is adapted to cause the second airflow to flow from the second engine compartment inlet via a circuitous path to the combustion chamber and to thereby cause a reduction of a water content of the second airflow.

In a further aspect, the second engine compartment inlet is disposed lower than the throttle body inlet.

In an additional aspect, the second engine compartment inlet is lower than the first engine compartment inlet.

In an additional aspect, a baffle is connected to at least one of the plurality of walls, the second engine compartment inlet being defined at least in part by the baffle.

In another aspect, the baffle extends downwardly from the first engine compartment inlet.

In yet another aspect, the second passage is defined at least in part by the baffle.

In a further aspect, a distance between the first inlet and the throttle body inlet is shorter in length than a distance between the second inlet and the throttle body inlet. For the purposes of the present application, terms related to spatial orientation when referring to an outboard engine and components in relation to the outboard engine, such as "forwardly", "rearwardly", "left", "right", "above" and "below", are as they would be understood by a driver of a boat to which the outboard engine is connected, with the outboard engine connected to the stern of the boat, in a straight ahead orientation (i.e. not steered left or right), and in an upright position (i.e. not tilted and not trimmed).

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

The description will refer to cowlings for outboard engines used to propel watercraft.

Figure 1A:
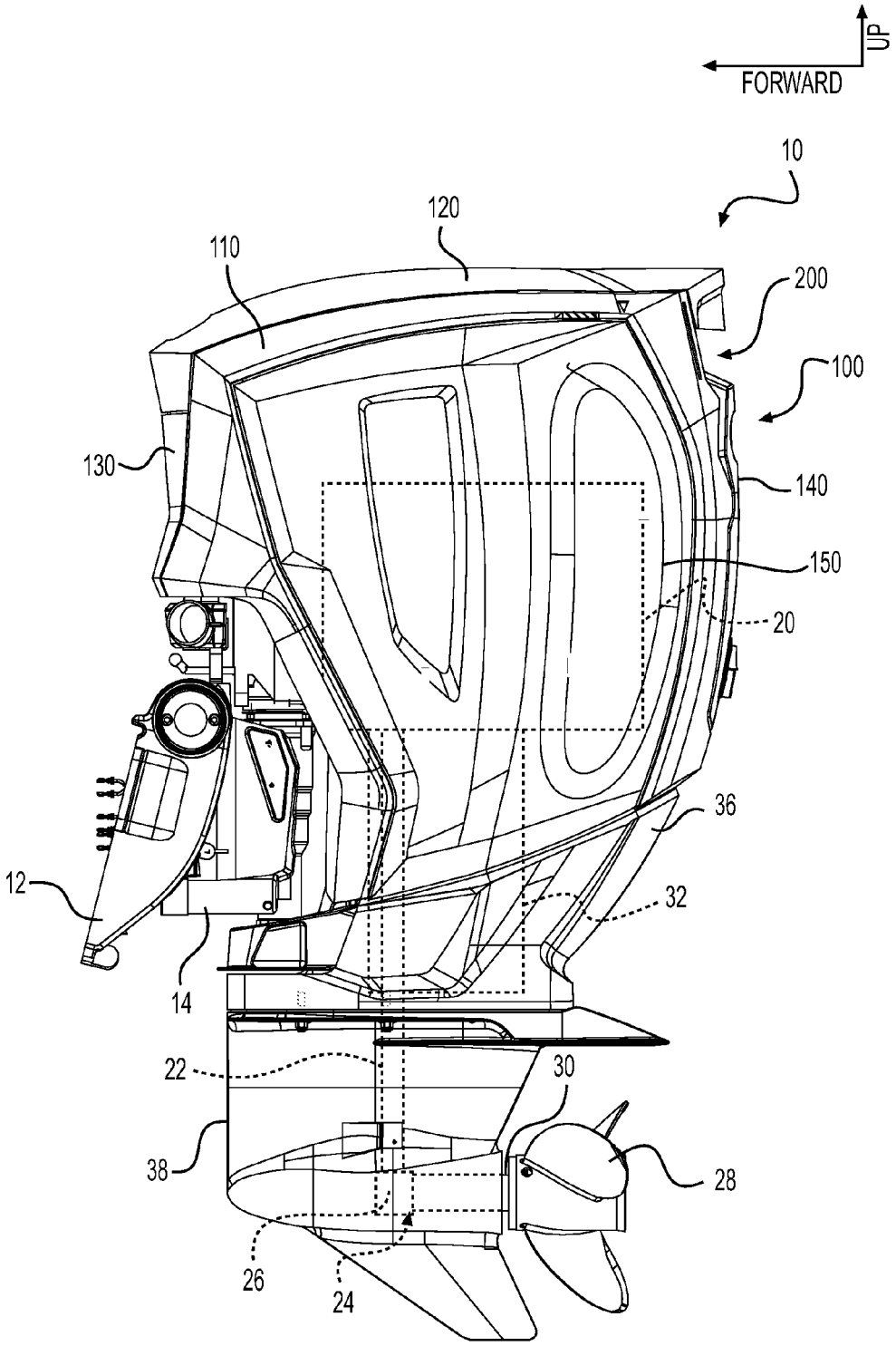
FIG. 1A is a left side elevation view of an outboard engine.
Figure 1B:
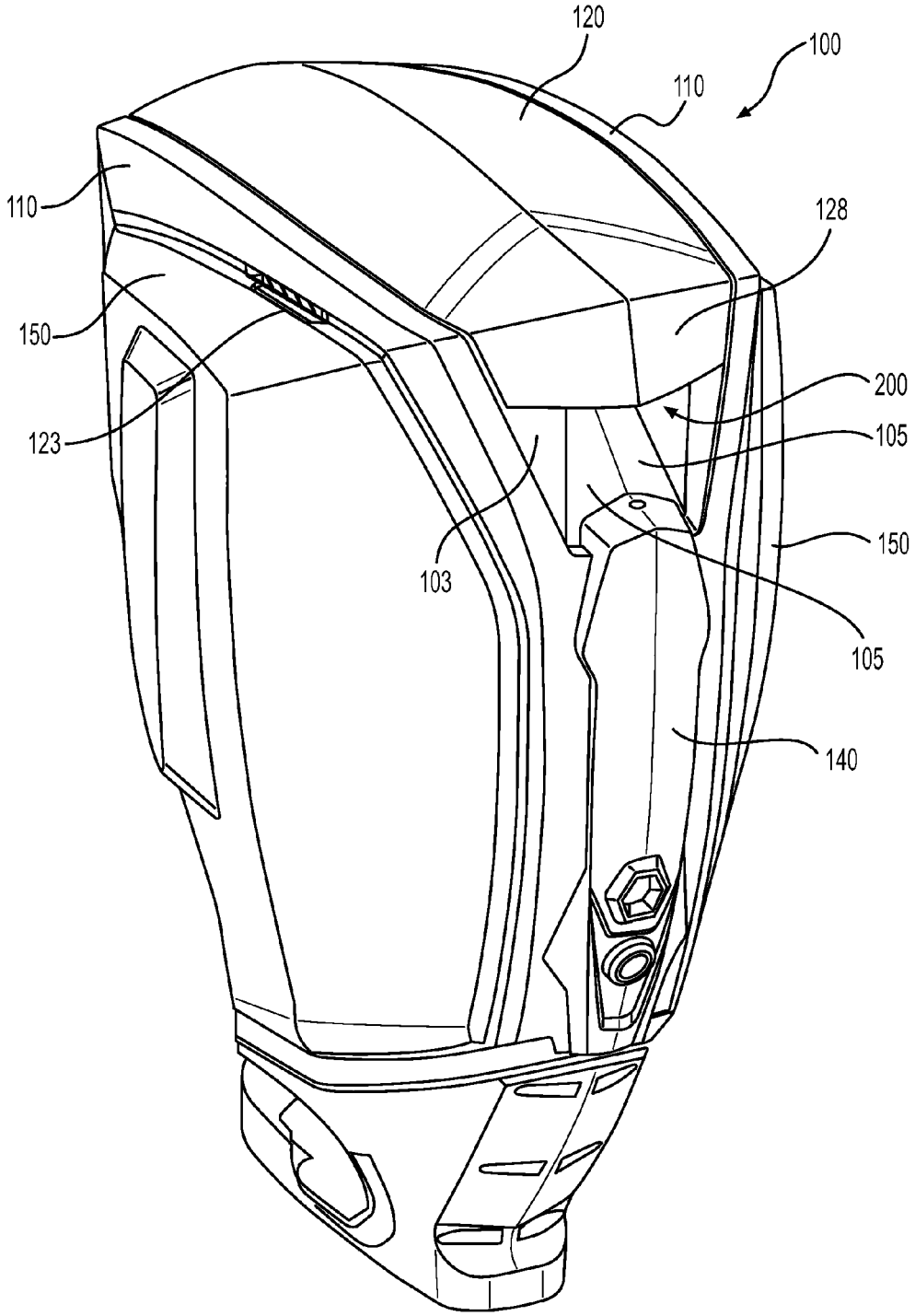
FIG. 1B is a perspective view, taken from a rear left side, of a cowling of the outboard engine of FIG. 1A.

With reference to FIGS. 1A and 1B, an outboard engine 10 has a cowling 100 protecting an engine 20 (shown schematically in FIG. 1A) and other components connected to the engine 20. The engine 20 and related components connected thereto are collectively referred to herein as a power head 21 (shown in FIGS. 7 to 10).

The engine 20 is housed in an engine compartment 102 (FIG. 4) formed by the cowling 100. The engine 20 is a direct injection, two-stroke, V-type, six-cylinder internal combustion engine. It is contemplated that other types of engines could be used, such as, but not limited to, carbureted engines, semi-direct injection engines, or four-stroke engines.

The outboard engine 10 is mounted to a transom of a boat by a mounting bracket, including a stern bracket 12 and a swivel bracket 14. The swivel bracket 14 connects the stern bracket 12 to the cowling 100, and the stern bracket 12 mounts the outboard engine 10 to the transom. The swivel bracket 14 partly houses a steering shaft (not shown) of the outboard engine 10. The brackets 12, 14 can take various forms, the details of which are conventionally known and will therefore not be discussed further herein.

The engine 20 is coupled to a vertically oriented driveshaft 22 (shown schematically). The driveshaft 22 is coupled to a drive mechanism 24 (shown schematically), which includes a transmission 26 (shown schematically) and a bladed rotor, such as a propeller 28 mounted on a propeller shaft 30. The propeller shaft 30 is generally perpendicular to the driveshaft 22, but could be at other angles. The drive mechanism 24 could also include a jet propulsion device, turbine or other known propelling device. The bladed rotor could also be an impeller. The drive mechanism 24 and a portion of the propeller shaft are housed within a gear case 38 of the outboard engine 10.

An exhaust system 32 (shown schematically), including an exhaust manifold 34 (best seen in FIG. 9), is connected to the engine 20. The exhaust system 32 is surrounded by the cowling 100. A lower portion of the exhaust system 32 is housed in a midsection 36 below the cowling 100 and above the gear case 38.

Figure 9:
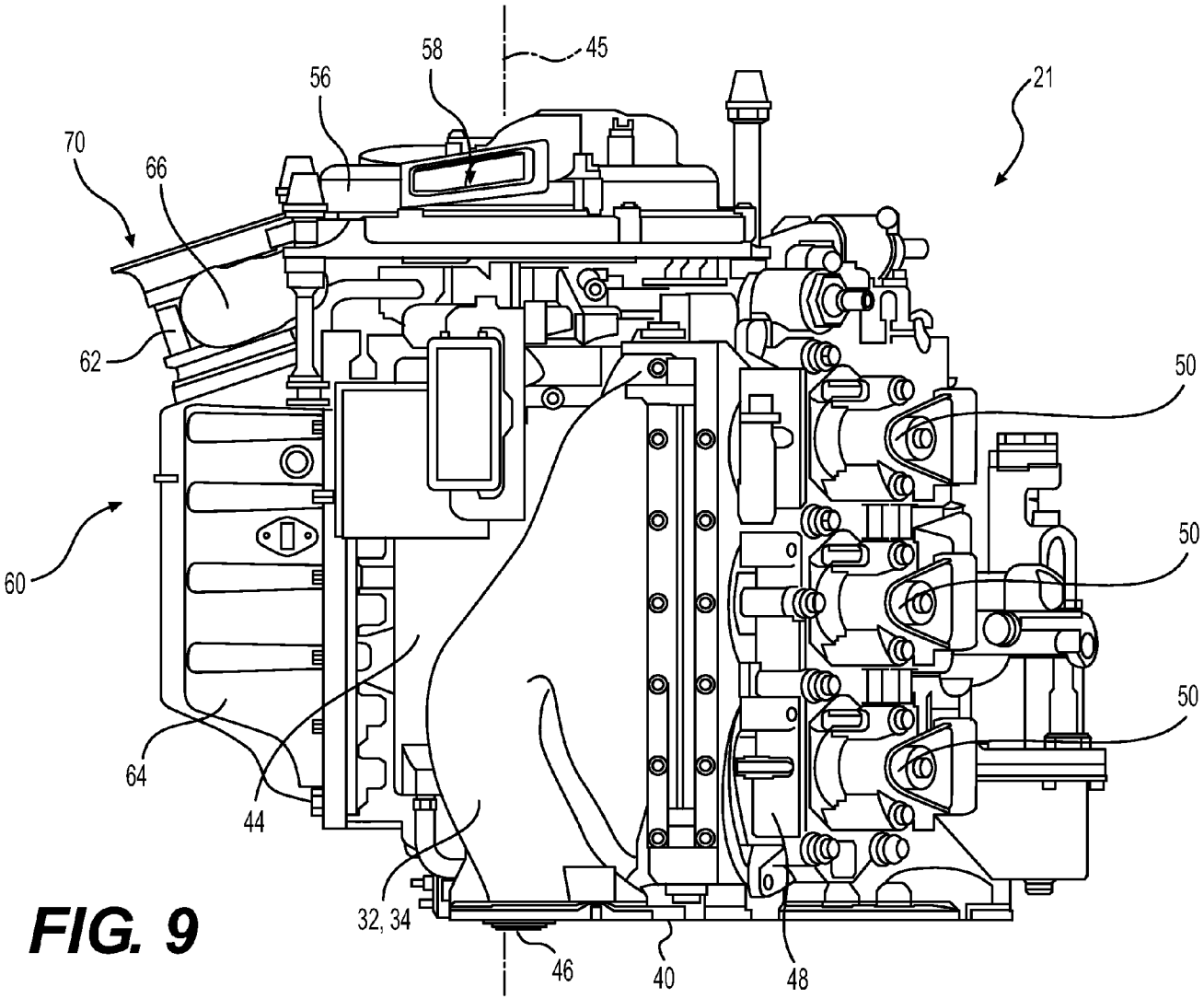
FIG. 9 is a left side elevation view of the power head of FIG. 7 shown in isolation.
Figure 10:
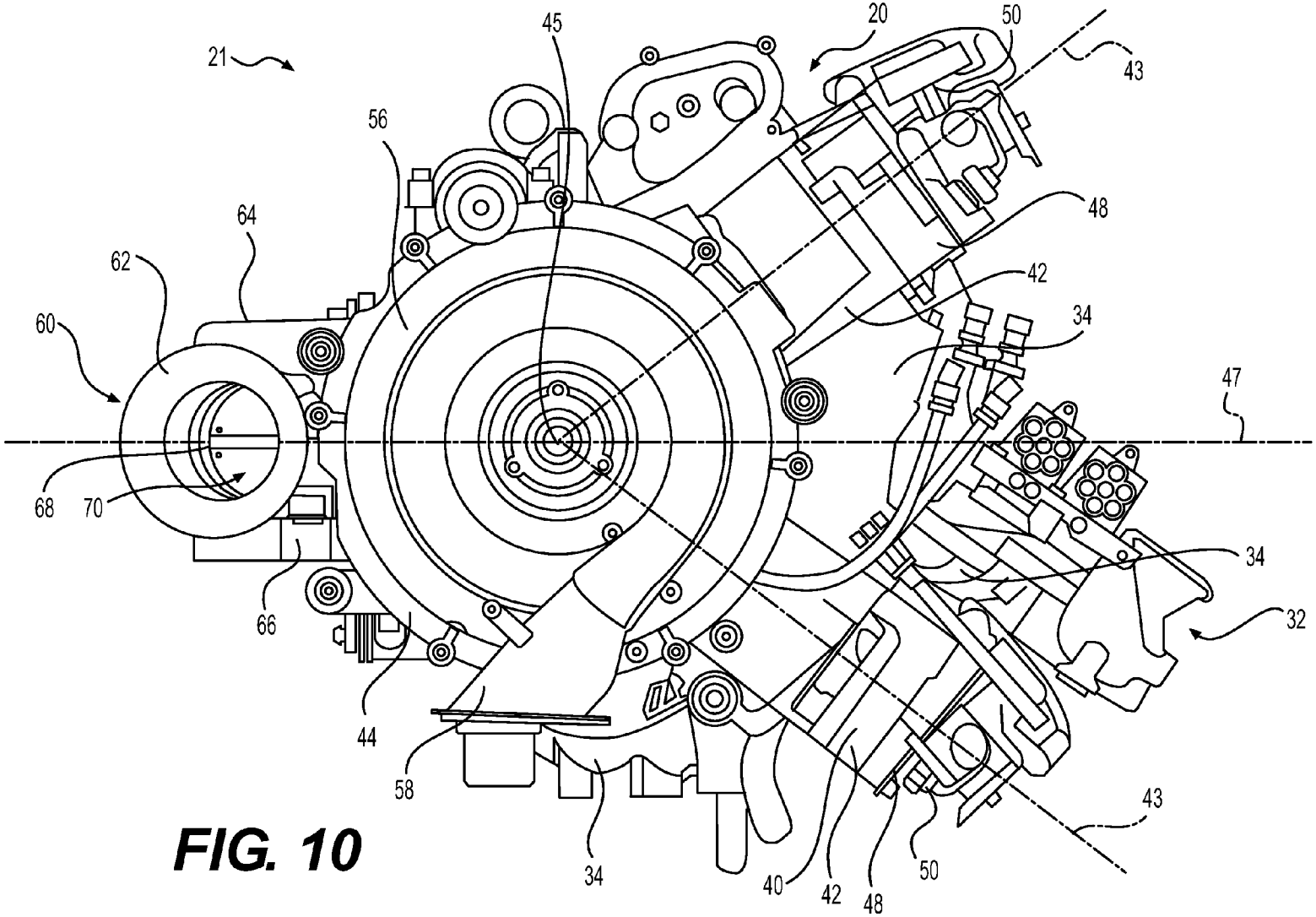
FIG. 10 is a top plan view of the power head of FIG. 9.

With reference to FIGS. 9 and 10, the engine 20 has a cylinder block 40 with two banks of three cylinders 42 arranged to form a V. It is contemplated that the cylinder block 40 could have more or less than six cylinders 42. It is also contemplated that the cylinders 42 could have a configuration other than a V-formation. For example, the cylinders 42 could be arranged inline, in which case the engine would be an inline-type engine.

The cylinder block 40 has a crankcase 44 connected to all six cylinders 42. A crankshaft 46, having a crankshaft axis 45 is rotatably disposed inside the crankcase 44. The bottom end of the crankshaft 46 extends out through a bottom wall of the crankcase 44 to be operatively connected to the driveshaft 22.

As best seen in FIG. 10, the three cylinders 42 of the right bank extend on the rear, right side of the crankcase 44. The cylindrical axis 43 of each cylinder 42 of the right bank is disposed at an angle of 40° with respect to a longitudinal center plane 47 containing the crankshaft axis 45. Similarly, the three cylinders 42 of the left bank of the V-formation extend on the rear, left side of the crankcase 44 so as to form an angle of 40° with respect to the longitudinal center plane 47. The front portion of each cylinder 42 is connected to the crankcase 44. A piston (not shown) is disposed inside each cylinder 12 to reciprocate therein along a reciprocation axis that is coaxial with the cylindrical axis 43 of the cylinder 42. Each piston is connected to the crankshaft 46 via a connecting rod (not shown) to drive the crankshaft 46. The rear end of the cylinders 42 of each bank is closed by a cylinder head 48 disposed thereon. Combustion chambers (not shown) are defined between the walls of the cylinder 42, the pistons and the cylinder heads 48. Fuel injectors 50, connected to the cylinders 42 by the cylinder heads 48, supply fuel to the combustion chambers. Spark plugs (not shown) connected to the cylinder heads 48 ignites the fuel-air mixture in the combustion chambers.

An exhaust manifold 34 is disposed on the left side of each bank of cylinders 42. Each cylinder 42 connects to its respective exhaust manifold 34 on its left side to expel exhaust gases resulting from the combustion process occurring in the cylinder 42.

An air intake system 60, including a throttle body 62 and a plenum 64, is connected to the crankcase 44 to supply air for the combustion process. The throttle body 62 has a throttle valve 68 and a throttle body inlet 70. Air enters via the throttle body inlet 70 into the throttle body 62. The throttle valve 68 regulates the amount of air flowing through the throttle body 62 into the plenum 64 and eventually into the combustion chamber of each cylinder 42. The throttle valve 68 is a butterfly valve comprising a circular disc mounted inside the tubular throttle body 62 that rotates about a rod passing through a diameter of the disc. The passage of air through the tubular throttle body 62 is obstructed by varying amounts as the disc rotates about the rod. A throttle valve actuator 66, in the form of an electric motor, is operatively connected to the throttle valve 68 to rotate the circular disc and thereby adjust the opening of the throttle valve 68. In the illustrated embodiment, the throttle valve 68 is controlled electronically by an electric actuator, but it is contemplated that the throttle valve 68 could be mechanically actuated by a mechanical linkage.

Air flows through the throttle valve 68 in the throttle body 62 into the plenum 64 which helps to equalize pressure of the air flowing therethrough into the crankcase 44. Reed valves (not shown) are placed in intake passages (not shown) connecting the plenum 64 to each chamber of the crankcase 44 to prevent backflow of air into the plenum 64. Air flows from the crankcase 44 via the passages in the cylinder 42 to the combustion chamber of each cylinder 42.

A flywheel/alternator (not shown) is located at the top end of the crankcase 44 and connected directly to the top end of the crankshaft 46 of the engine 20. The mass of the flywheel facilitates smooth operation of the engine by helping maintain constant angular velocity between engine firings, and can also act as a pull-start system for manually starting the engine 20 in some embodiments. A cover 56 is placed over the rotating flywheel. A volute shaped channel 58 formed in the cover 56 guides turbulent air from around the flywheel out of the engine compartment 102.

An engine control unit (ECU) 72 (seen in FIGS. 5 to 8) is operatively connected to the engine 20 to control operation of the engine 20. The ECU 72 is in electronic communication with various sensors from which it receives signals. The ECU 72 uses these signals to control the operation of the throttle valve actuator, the ignition system (not shown), and the fuel injectors 50 in order to control the engine 20.

The configuration of the engine 20 and other components of the power head 21, as described above, is intended to be exemplary. It is contemplated that the engine 20 could be configured differently. For example, the engine 20 could have more or less than six cylinders 42, the cylinders 42 could be arranged inline or at a different angle with respect to the longitudinal center plane 47 than as shown herein. A single exhaust manifold 34 could be connected to all the cylinders 42 instead of two manifolds 34 as shown. A throttle body 62 could be connected directly to each cylinder 42 instead of through the crankcase 44.

The outboard engine 10 also has other components housed within the engine compartment 102, such as an oil filter, an oil pump, spark plugs and the like. As it is believed that these components would be readily recognized by one of ordinary skill in the art, further explanation and description of these components will not be provided herein.

Figure 7:
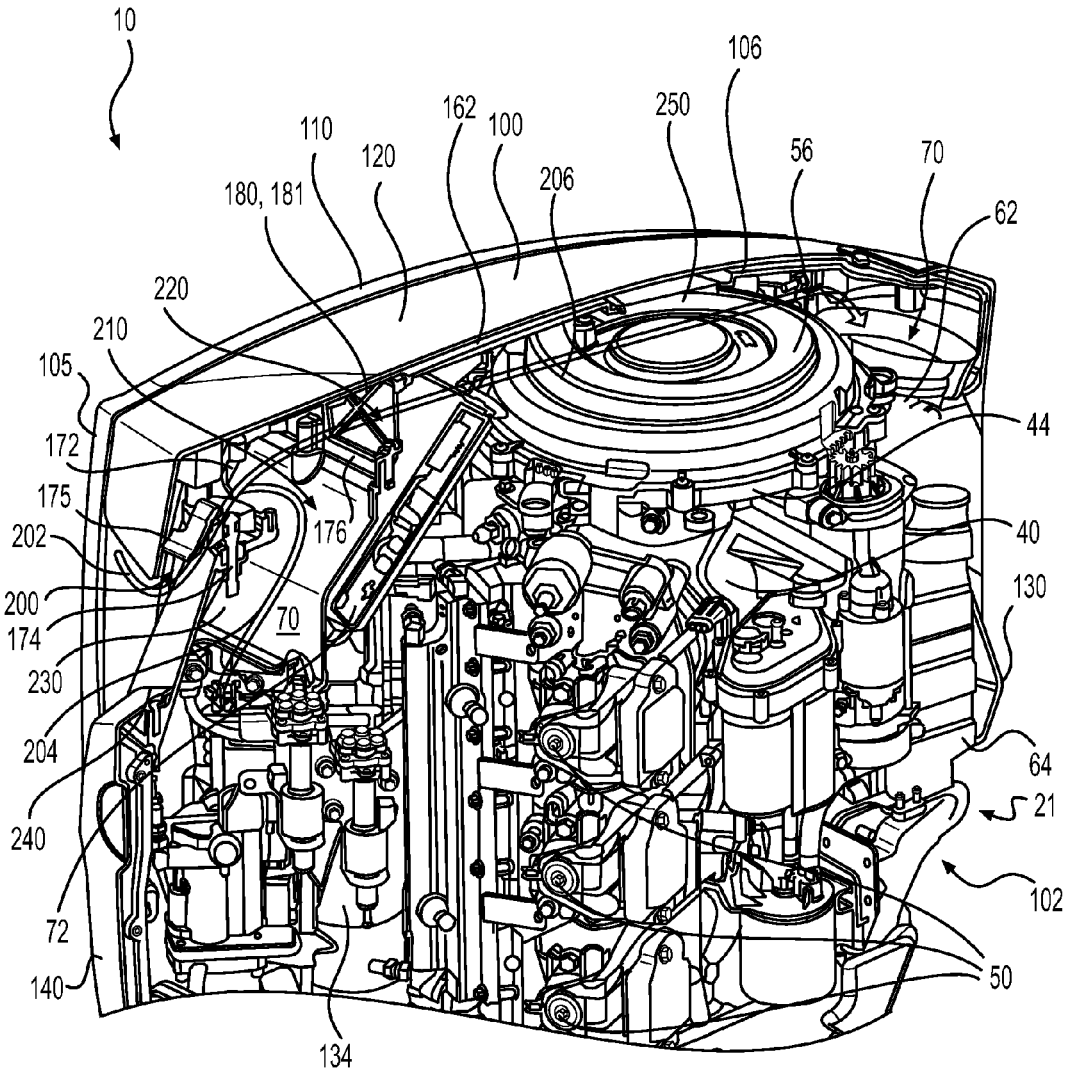
FIG. 7 is a partially cut-away perspective view, taken from a rear, right side of a portion of the outboard engine of FIG. 1 with the right side of the cowling being cut away to show a power head, including an engine and related components, housed inside the engine compartment formed by the cowling.
Figure 8:
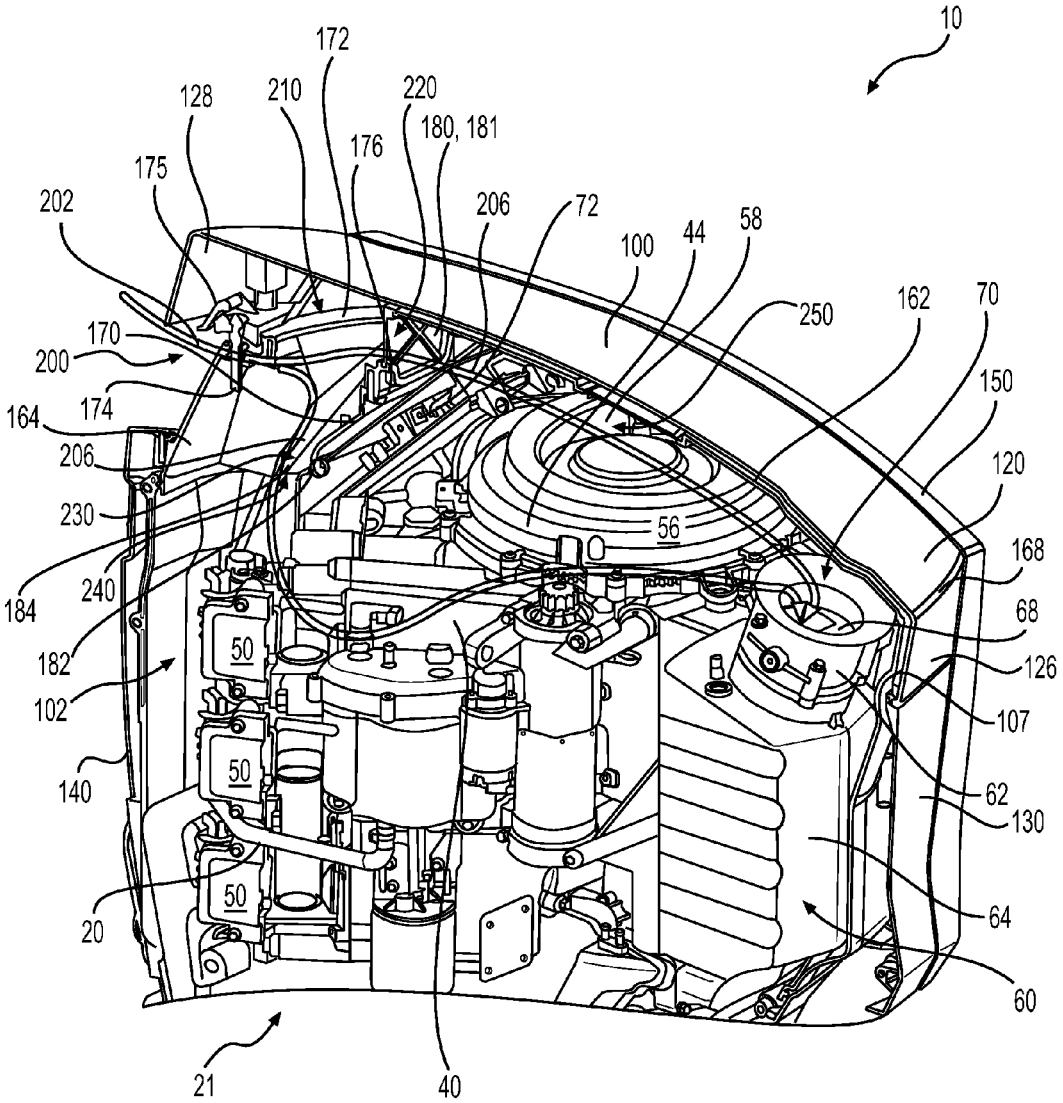
FIG. 8 is a partially cut-away perspective view, taken from a front, right side of the portion of the outboard engine of FIG. 7.

As can be seen in FIGS. 7 and 8, the cowling 100 extends from above the flywheel cover 56 at the top of the engine 20 to a point vertically below the crankcase 44. It is contemplated that the cowling 100 could extend above or below the point vertically below the middle of the swivel bracket 14. The cowling 100 includes a support structure 105 and a plurality of panels 120, 130, 140, 150.

The engine 20 is connected to the support structure 105. The support structure 105 extends across portions of the front, the top and the back of the engine 20. A bottom of the support structure 105 is open, and connects to the exhaust system 32. It is contemplated that the support structure 105 could (instead or in addition) be fixed to the swivel bracket and/or the exhaust system 32. While it is possible to disconnect the support structure 105 from the engine 20, the support structure 105 stays fixed to the engine 20 during routine use.

The panels 120, 130, 140, 150 are removably connected to the support structure 105. The panels 120, 130, 140, 150 are a top cover or cap 120, a front cover 130, a rear (or back) cover 140, a left side panel 150 and a right side panel 150. The panels 120, 130, 140, 150 are connected to an exterior of the support structure 105. The support structure 105 supports the panels 120, 130, 140, 150 and connects them to the engine 20. The panels 120, 130, 140, 150 with portions of the support structure 105 form an outer surface of the cowling 100. The panels 120, 130, 140, 150 enclose or otherwise cover the engine 20. The panels 120 and 150 provide access to different parts of the engine 20 when removed.

The support structure 105 is made of plastic. It is contemplated that the support structure 105 could be made of metal, of composite material or of a combination of various materials. The panels 120, 130, 140, 150 are each a single molded piece made of the same plastic as the support structure 105. It is contemplated that the panels 120, 130, 140, 150 could be made of a material other than the one of the support structure 105 and other than a plastic.

With reference to FIGS. 1B to 9, the cowling 100 and the air intake system for communicating air from outside the engine compartment 102 into the throttle body inlet 70 of the engine 20 will now be described in more detail.

The support structure 105 includes a central upper portion 106 and a central front portion 107 connected thereto. The support structure 105 also includes a left (port) structural panel 110 and a right (starboard) structural panel 110 connected to the central upper and front portions 106, 107.

The central upper portion 106 of the support structure 105 includes a top wall 162 extending across the top of the engine 20 and a rear wall 164 extending along an upper portion rearward of the engine 20. The rear wall 164, spaced from the top wall 162, slopes downwardly and rearwardly away from the top wall 162. A wall 176 extends downwards from the rear end of the top wall 162. A baffle 170 (best seen in FIG. 6) extends downwards from the wall 176. A left side wall 166

(FIGS. 3 to 5) of the central upper section 106 extends from the top wall 162 downwards along the left side of the engine 20 and a corresponding right side wall (not shown) extends downwards along the right side of the top wall 162. The rear portion of the side wall 166 slopes downwards and rearwards behind the top wall 162 to the bottom end 184 of the rear wall 164.

Figure 5:
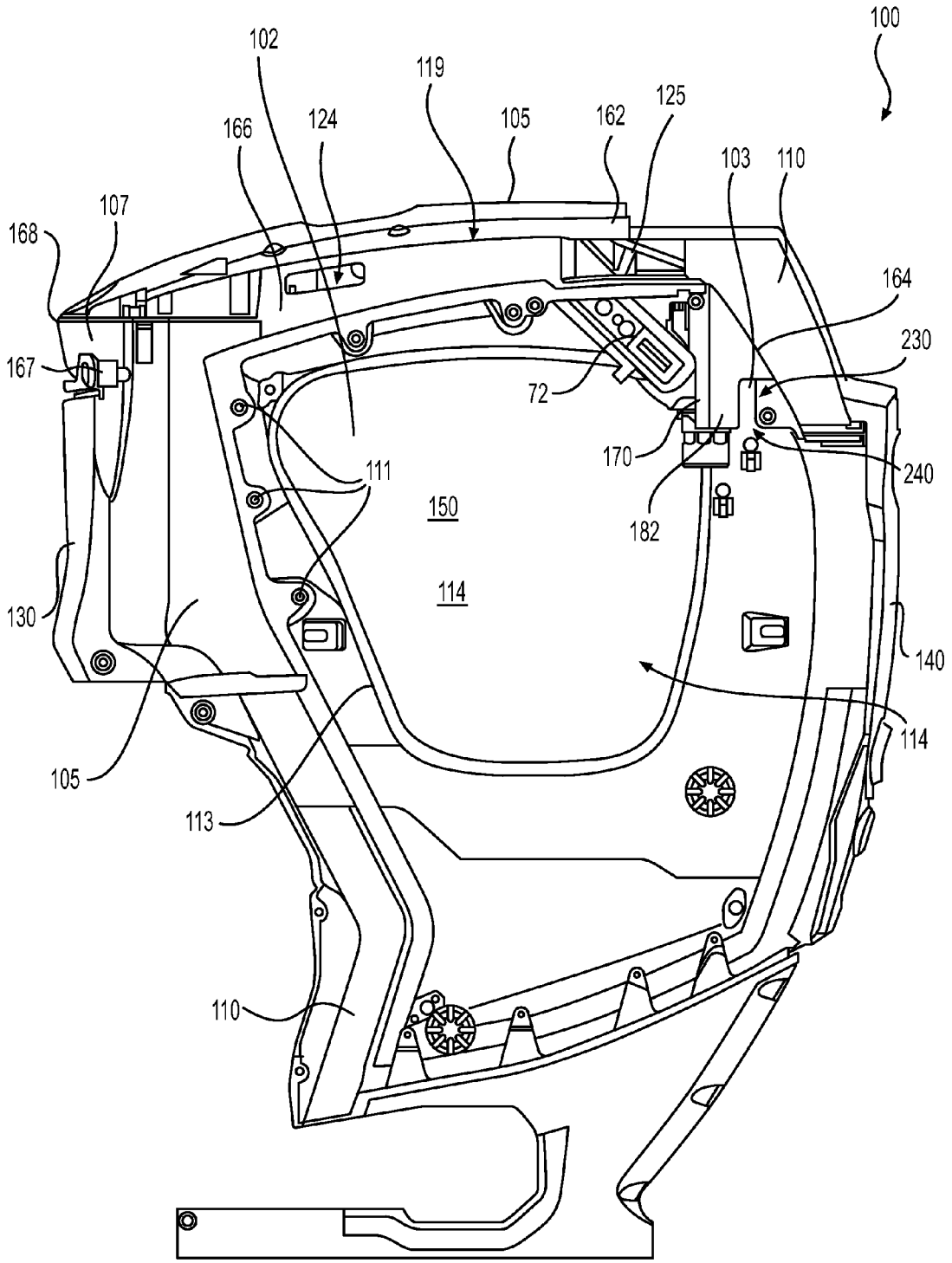
FIG. 5 is a left side elevation view of the cowling portion of FIG. 4.

The central front portion 107 (FIG. 8) of the support structure 105 extends downwards from the front end 168 of the top wall 162 and forward of the engine 20. The central front portion 107 is attached to central upper portion 106 by a flange 169 (FIG. 3) extending downwards form the front edge 168. The lower portion of the left and right sides of the central front portion 107 are also attached to the corresponding left and right structural panels 110 by bolts 111 (FIG. 5).

A main air inlet 200 is defined between the top cap 120 and the rear wall 164 of the central upper portion 106. An outer chamber 103 is defined between the rear wall 164, the vertical wall 176 and the baffle 170. Air from outside the outboard engine 10 enters the outer chamber 103 via the main air inlet 200.

An air inlet 210 is formed in the space between the vertically extending wall 176 and the rear wall 164. This air inlet 210 has a generally semi-circular shape and is surrounded by a curved flange 172, hereinafter referred to as a lip 172, that will be discussed in further detail below. Another air inlet 220 is defined in the vertically extending wall 176. A hydrophobic mesh 180, which will be discussed in further detail below, is positioned across the inlet 220. The inlets 210, 220 fluidly communicate the outer chamber 103 with the engine compartment 102. The inlets 210, 220 remain open during operation of the engine 20 so that air can flow into the engine compartment 102 for operation of the engine 20. The inlets 210, 220 will be discussed in further detail below.

The engine oil is refillable via an aperture formed in the top wall 162 that provides access to an oil tank (not shown) mounted to the engine 20 beneath the cowling 100 and that is shown closed by a cap 121 in the figures.

Air can also enter the outer chamber 103 via left and right apertures 125 formed in respective side walls 166, rearward of the rear end of the top wall 162 and the vertically extending wall 176. The apertures 125 fluidly connect to the main air inlet 200. The side air inlets 125 can also be used to evacuate water that enters the outer chamber 103 via the main inlet 200, for example when operating the outboard engine 10 in reverse. Water that enters the cowling 100 through the main inlet 200 can flow out of the outer chamber 103 and out of the outboard engine 10 via the apertures 125.

A rectangular aperture 124 is disposed in the front portion of the left side wall 166 for expelling air from the engine compartment 102. The aperture 124 connects to the channel 58. In the illustrated embodiment, the side walls 166 are spaced from the left and right structural panels 110 placed thereover. Air expelled through the aperture 124 flows rearward along the space between the left structural panel 110 and the left side wall 166 to be expelled outside rearward of the outboard engine 10. In an alternate embodiment, the left structural panel 110 has an aperture corresponding to the aperture 124 of the left side wall 166. The channel 58 connects through the side wall aperture 124 to the structural panel aperture to directly expel air outside on a left side of the outboard engine 10. It is also contemplated that the flywheel cover 56, the channel 58 and/or the aperture 124 could be omitted.

The left structural panel 110 extends generally across the left side of the engine 20. The left structural panel 110 forms a left lateral side aperture 114 that reveals portions of the left side of the engine 20. The left structural panel 110 extends from the top left edge of the central upper portion 106 to a point below the engine 20. Similarly, the right structural panel 110 extends from the top right edge of the central upper portion 106 downward to a point below the engine 20 and defines a right lateral aperture 114 that reveals portions of the engine 20 and power head 21. The left and right structural panels 110 are mirror images of one another. As such only the left structural panel 110 will be described below for simplicity. The left structural panel 110 also extends forwardly as well as rearwardly of a portion of the left side of the engine 20 and power head 21. The portions of the engine 20 revealed by the left lateral side aperture 114 are selectively covered by the left side panel 150. It is contemplated that the left structural panel 110 could have none or more than one lateral side aperture 114 and that more than one side panel 150 could cover these lateral side apertures 114. The left and right structural panels 110 are bolted to each other at various connection points in the front and the back. It is contemplated that the structural panels 110 could be secured to each other, other than by bolts, and that a seal could be disposed along the connection seam between the structural panels 110.

It is contemplated that the support structure 105 could be configured differently than as shown. For example, the support structure 105 could be one or more beams or trusses which extend across and at least partially surround the engine 20 without covering it, and external panels could connect to the beams such that they cover both the engine 20 and the beams or trusses.

The left and right side covers 150 are mirror images of one another and only the left side cover 150 will be described below for simplicity. The left side cover 150, friction fitted to the left structural panel 110, covers the left lateral side aperture 114. The left side cover 150 is slightly curved outwardly to accommodate a shape of the engine 20. A water tight connection between the left structural panel 110 and the left side cover 150 is ensured by a seal disposed on the left side cover 150 and adapted to contact with a rim 113 of the left lateral side aperture 114. The left side cover 150 is larger than the left lateral aperture 114 so as to cover a portion of the left structural panel 110 and provide an additional barrier to water leaking into the engine compartment 102. The left and right side covers 150 may be removed to access the engine 20 for maintenance and/or servicing. It is contemplated that the left and right side covers 150 could not be minor images of one another.

Figure 2:
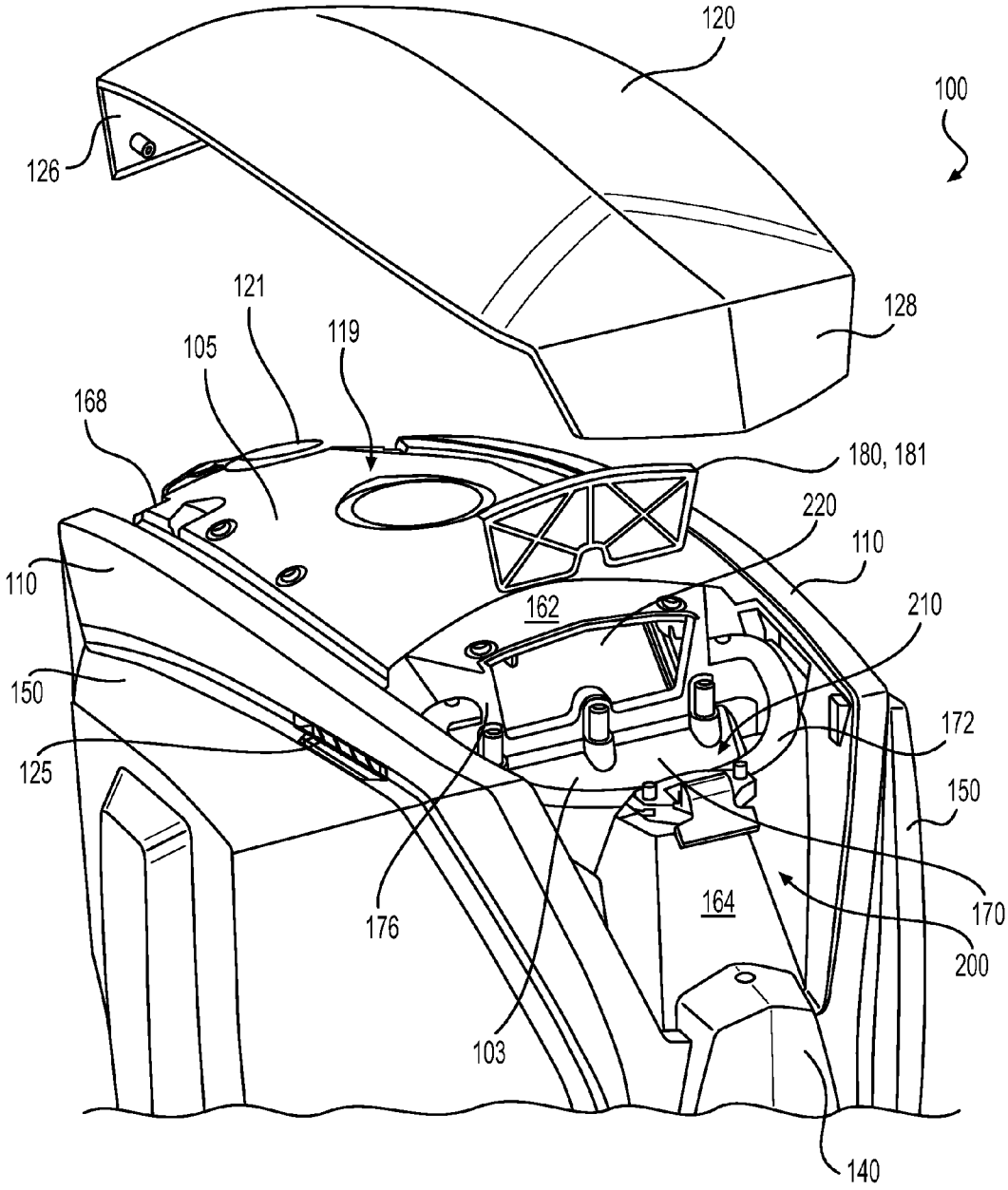
FIG. 2 is a partially exploded perspective view, taken from a rear left side, of an upper portion of the cowling of FIG. 1B.
Figure 3:
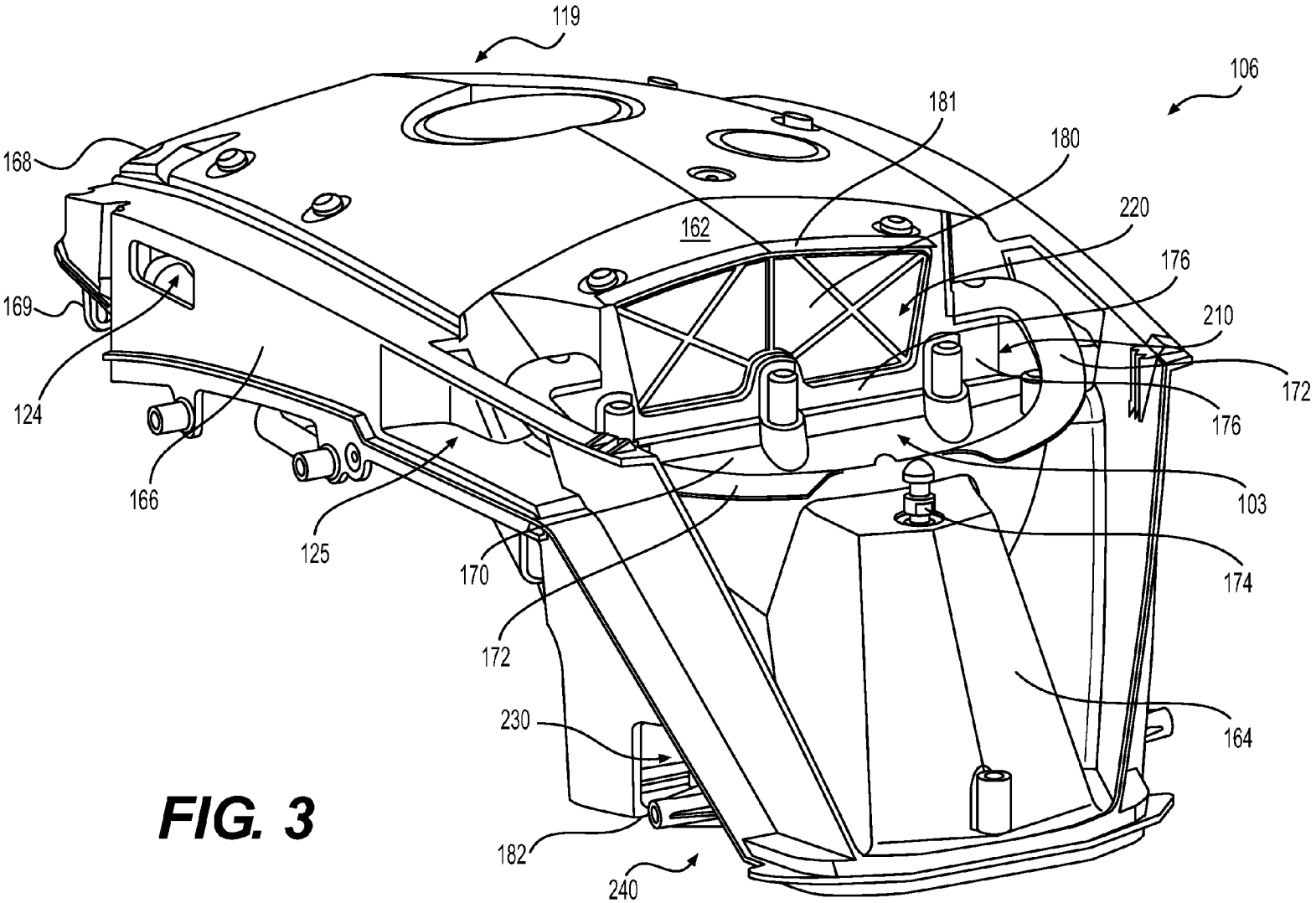
FIG. 3 is a perspective view, taken from a rear left side, of an upper central portion of a support structure of the cowling of FIG. 1B.

An opening 123 is defined at the connection between each structural panel 110 and the corresponding side cover 110 as can be seen clearly in FIGS. 1A, 1B and 2. The opening 123 is aligned with the aperture 125 on the side walls 166 of the central upper portion 106. Air from outside the outboard engine 10 flows into the inlet 125 via the opening 123.

With reference to FIGS. 1B, 2, 7 and 8, the top cover or cap 120 is an elongated panel extending from the front of the support structure 105 to the back of the support structure 105. The top cover 130 covers a servicing area 119 of the central upper portion 106 that includes the cap 121. The top cover 120 is removably attached to the support structure 105. The top cover 120 has front and back flanges 126, 128 with gripping areas to facilitate installation and removal of the top cover 120 from the support structure 105. Posts on the inner surface of the front flange 126 are used to clip the front of the top cover 120 to the central front portion 107 of the structure 105. A latch 175 on the inner surface of the top cover 120 just forward of the rear flange 128 engages a post 174 of the rear wall 164 of the upper central portion 106 to removably attach the top cover 120 to the support structure 105.

Figure 4:
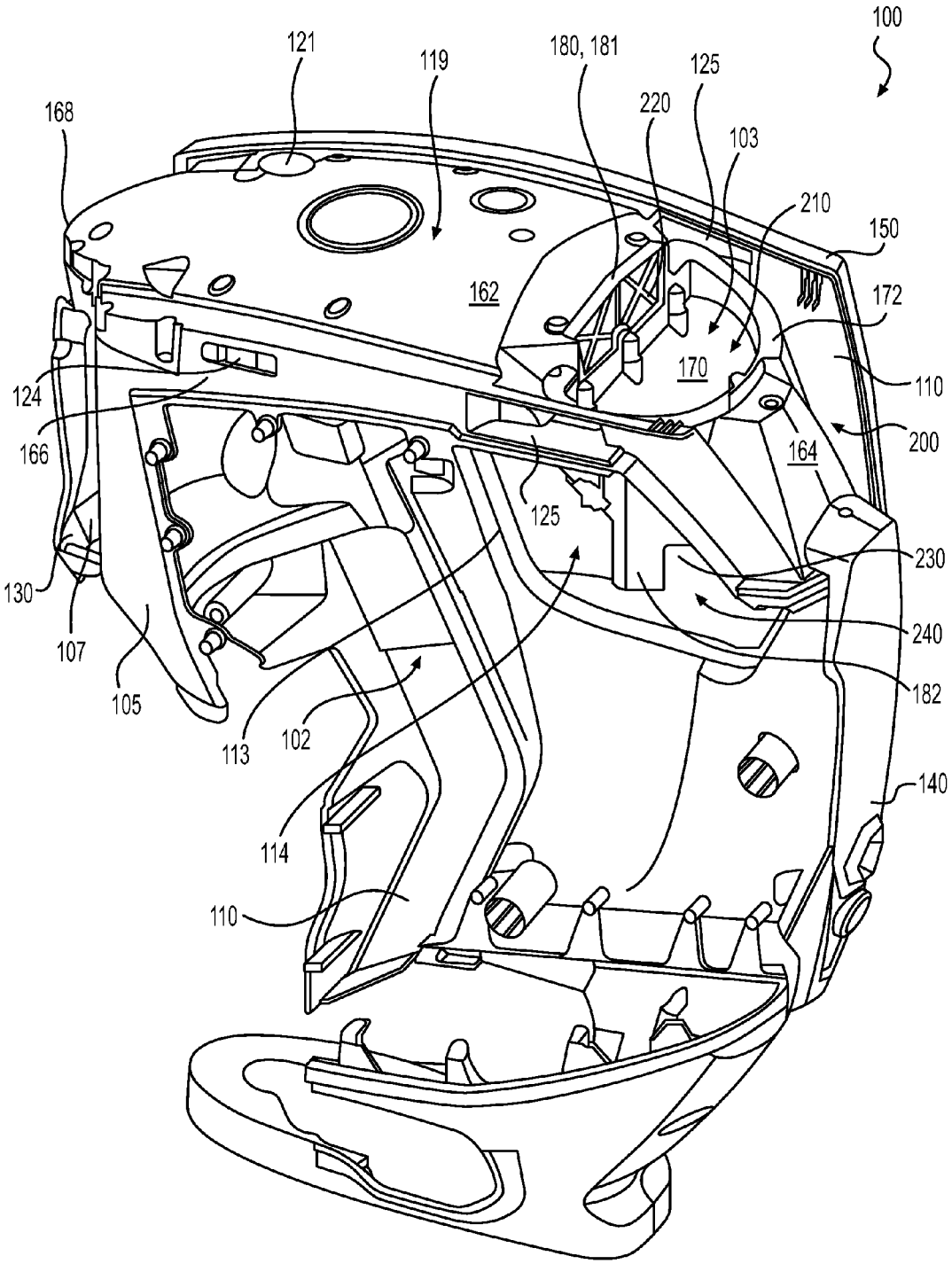
FIG. 4 is a perspective view, taken from a rear left side, of a portion of the cowling of FIG. 1B with a top cover, a left side cover, and a left structural panel removed.

As best seen in FIGS. 4 and 5, the front cover 130 is attached to the front central portion 107 and each of the left and right structural panels 110. The front flange 126 of the top cover 120 is then attached over the front cover 130 by a pair of friction pins 167 (the left one can be seen in FIG. 5). The front cover 130 is generally not removed except during initial rigging of the outboard engine 10.

Similarly, the back cover 140 covers a rear portion of the vertical connection seam between the structural panels 110 so as to provide an additional barrier to water and external elements. The upper end of the back cover 140 is disposed above the bottom of the central portion 106. The lower rear ends of the structural panels 110 extend below the lower end of the back cover 140. The upper end of the back cover 140 is bolted to the rear wall 164 of the upper central portion 106 and the lower end of the back cover 140 is clipped to the structural panels 110.

It is contemplated that any of the covers 120, 130, 140, 150 could have a shape and/or size that is different from that shown in the Figures. For example, the side covers 150 could be curved so as to accommodate portions of the engine 20 protruding through the lateral side apertures 114. As another example, the side covers 150 could be of the size of their corresponding lateral side aperture 114. It is contemplated that a seal could be disposed between any of the covers 120, 130, 140, 150 and the support structure 105. It is contemplated that the covers 120, 130, 140, 150 could be connected to the support structure 105 by means other than as shown herein. For example, the front cover 130 and the back cover 140 could be hinged or friction fitted to the support structure 105.

It is also contemplated that some or all of the panels 120, 130, 140, 150 could themselves support other panels. It is contemplated that some or all of the panels 120, 130, 140, 150 could not be removable from support structure 105, but be only partially selectively connected to the support structure 105, by for example by a hinged connection. It is contemplated that the cowling 100 could comprise more or less than the panels 120, 130, 140, 150, and that some of the panels 120, 130, 140, 150 could not be external panels of the cowling 100.

As can be seen best in FIGS. 1B, 7 and 8, the main air inlet 200 is formed by the gap between the rear flange 128 of the top cover 120 and the rear wall 164. The latch 175 can be accessed by hand via the main air inlet 200 for removing the top cover 120.

Figure 6:
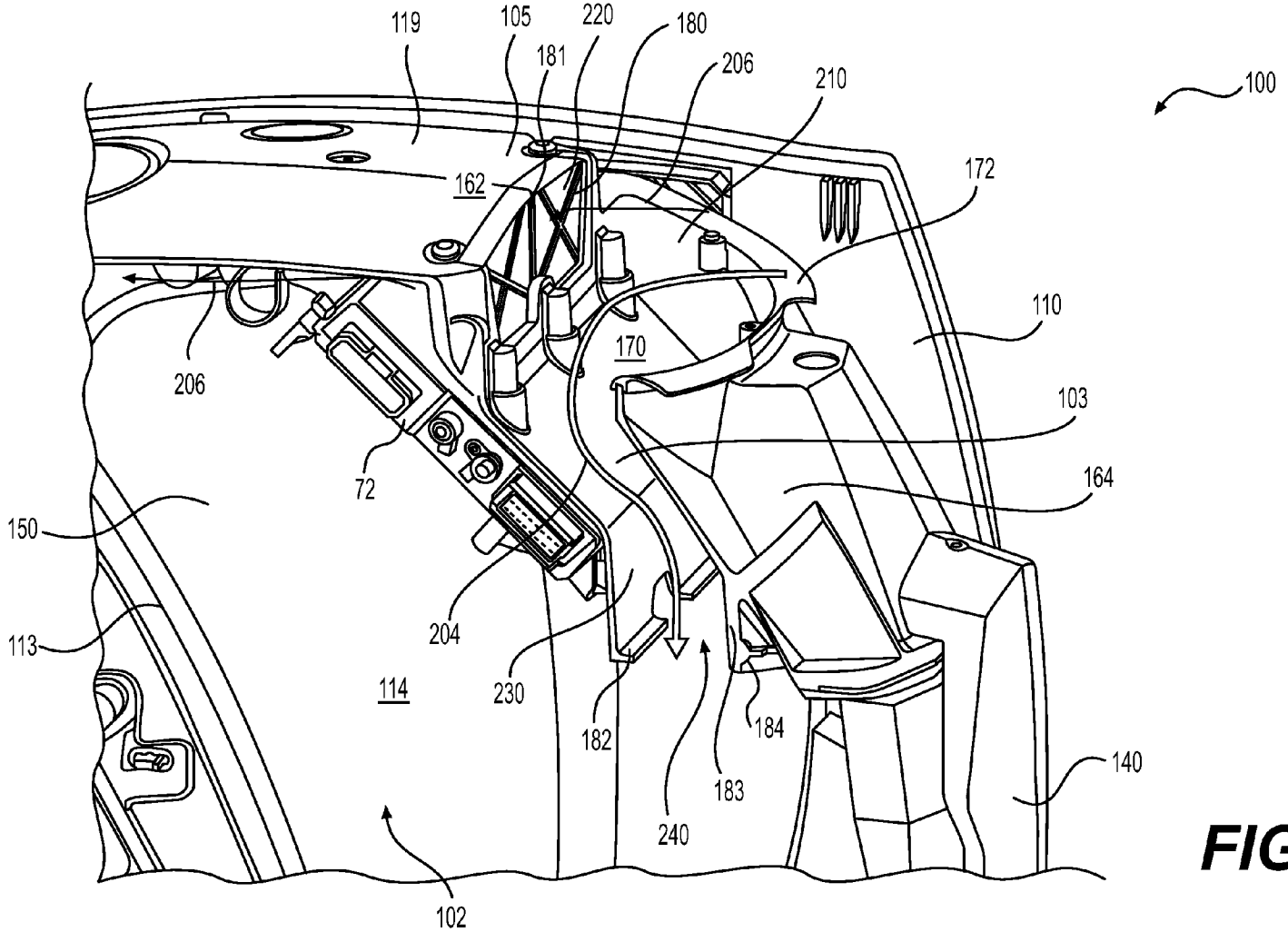
FIG. 6 is a close-up and cut-away perspective view, taken from a rear, left side, of a rear, upper portion of the cowling portion of FIG. 4 having an engine control unit mounted thereto.

With reference to FIGS. 6 to 8, the inlets 210, 220 of the upper central portion 106 of the support structure 105 fluidly communicate with the main inlet 200. An airflow 202 from outside the outboard engine 10 flows through the main inlet 200, and then via the inlets 210 or 220 into the engine compartment 102. A portion 204 of the airflow 202 flows via the inlet 210 into the engine compartment 102. Another portion 206 of the airflow 202 flows via the inlet 220 into the engine compartment 102.

The inlet 210 has a substantially semi-circular shape. It is contemplated that the shape of the inlet 210 could be other than semi-circular. A front edge of the inlet 210 is defined by the vertical wall 176 and the mesh 180 thereacross. The left, right and rear edges of the inlet 210 are defined by the upper end of the rear wall 164. The lip 172 extends outwardly and horizontally away from the inlet 210. The lip 172 is bolted to the central upper portion 106 substantially around the inlet 210, although it is contemplated that the lip 172 could be integral with the central upper portion 106. The lip 172 is broken at its rear so as to define a space to accommodate the post 174, although it is contemplated that the lip 172 could be formed continuously along the left, rear and side edges of the inlet 210. The lip 172 guides and smoothes airflow 202 flowing from the main inlet 200 into the inlet 210.

The baffle 170 (best seen in FIG. 6) extends downwards from the wall 176, and is spaced from the rear wall 164 of the support structure 105 forming a passage 230 therebetween. The baffle 170 is bolted to the central upper portion 106, but it is contemplated that the baffle 170 could be attached to the wall 176 by other means. It is also contemplated that the baffle 170 could be formed integrally with the wall 176. The baffle 170 extends generally downward away from the inlet 210 to direct air in a downward direction into the engine compartment 102. The upper portion of the baffle 170 extends downwardly and rearwardly from the vertical wall 176. The ECU 72 is mounted along the inner face of the baffle 170. The lower portion of the baffle 170 extends vertically to a bottom edge 182. The bottom edge 182 of the baffle 170 is disposed at the same level as the bottom edge 184 of the rear wall 164. The baffle 170 has left and right side portions 171 that extend rearwardly, towards the rear wall 164.

The passage 230 is formed between the baffle 170 and the rear wall 164. The passage 230 extends between the air inlet 210 at its top and an engine compartment inlet 240 at its bottom. The engine compartment inlet 240 is defined by the bottom edges 182 and 184 of the baffle 170 and the rear wall 164, respectively. The inlet 240 fluidly connects the passage 230 with the engine compartment 102. The upper portion of the passage 230 extends downwardly and rearwardly from the inlet 210. The lower portion of the passage 230 extends vertically to the inlet 240. The inlet 240 is horizontal and faces downwardly. The inlet 240 is disposed at a level below the level of the throttle body inlet 70.

The various panels and walls of cowling 100, as described above, define the engine compartment 102. The engine compartment 102 therefore has an upper portion disposed adjacent the top wall 162, rearward of the central front portion 107, and forward of the baffle 170. The left and right structural panels 110 and the left and right side covers 150 define the lateral sides of the engine compartment upper portion 102. A middle portion of the engine compartment 102 is defined by the central front portion 107, the left and right structural panels 110, the left and right side covers 150, and the rear wall 164 of the central upper portion 106. In the lower portion, the engine compartment 102 is defined by the left and right structural panels 110 which are connected to each other forward and rearward of the engine 20.

As mentioned above, the cowling 100 also defines the outer chamber 103 which fluidly connects the engine compartment 102 to the outside. The outer chamber 103 is defined between the rear portion of the top wall 162, the vertical wall 176, the baffle 170, and the rear wall of the top cover 120. The outer chamber 103 comprises the passage 230. The outer chamber 103 is connected to the engine compartment 102 by the engine compartment inlet 240 at the bottom of the passage 230 and the air inlet 220. Airflow 202 enters the outer chamber 103 via the main air inlet 200.

A portion 204 of the airflow 202 flows from the main inlet 200 into the passage 230 via the inlet 210 and into the engine compartment 102 via the engine compartment inlet 240. Inside the engine compartment 102, the airflow 204 flows from the inlet 240 around the engine 20 and various components of the power head 21 before being drawn via the throttle body inlet 70 into the throttle body 62 of the engine 20.

The airflow 204 thus follows a circuitous path from the inlet 210 to the throttle body inlet 70. The airflow 204 is subjected to many changes in airflow direction, including direction reversals, before it reaches the throttle body inlet 70. Specifically, the airflow 204 enters through the inlet 200, flows upwardly and forwardly along the outside of the rear wall 164 into the outer chamber 103, then reverses direction to bend around the lip 172 and flow through the inlet 210 and then downwardly and rearwardly along the passage 230 between the baffle 170 and the rear wall 164. Upon entering the engine compartment 102, this airflow 204 must again change direction as it flows through the downwardly facing inlet 240 towards the throttle body inlet 70, bending around the bottom edge 182. This circuitous path taken by the airflow 204 between the inlet 210 and the throttle body inlet 70 therefore constitutes two reversals in direction, both of which serve to separate water form the airflow 204 as the water contained in the airflow 204 is much less able to flow along circuitous paths and/or in an upward direction. It is contemplated that more or less reversals in direction could similarly be used to separate water from air.

In the illustrated embodiment of the outboard engine 10, the airflow 204 flowing downward along the passage 230 contains water (including water removed from the airflow 206 by the mesh 180 as will be explained below). When the airflow 204 reaches the bottom of the passage 230 and the bottom end 182 of the baffle 170, the airflow 204 spreads outward from the inlet 240. A portion of the airflow 204 is drawn forwards into the engine compartment 102. The airflow 204 flows upwards along at least one portion of its path between the inlet 240 and the throttle body inlet 70 positioned higher than the inlet 240. After passing through the inlet 240, the water contained in the airflow 204, however, continues to flow downward under the influence of gravity and is thereby separated from the airflow 204.

A foam sealing element (not shown) is placed around the exhaust passage 34 and/or the power head 21, thereby defining the lower limit of the engine compartment 102. The water flowing downward flows out of the engine compartment 102 via a water drain valve (not shown) located in the foam sealing element at a position below the passage 230. The water flows through the water drain valve into the midsection 36 of the engine 20 and eventually out of the outboard engine 10 between the panels of the midsection 36 or via another outlet as is known in the art. The water drain valve is a one-way valve that prevents backflow of water from the midsection 36 through the drain valve and back into the engine compartment 102. When the watercraft having the outboard engine 10 mounted thereon is in water, a portion of the midsection 36 is generally disposed below or near the water surface. The midsection 36 therefore likely contains some water therein.

The other inlet 220 is disposed adjacent the top wall 162. Thus, the upper portion of the inlet 220 is higher than the top of the engine 20. The upper portion of the other inlet 220 is disposed at a level above the horizontal lip 172. The hydrophobic mesh 180 is placed across the inlet 220. A portion 206 of the airflow 202 flowing from outside the outboard engine 10 through the main inlet 200, flows through the inlet 220 and straight into the engine compartment 102. Accordingly, the inlet 220 can be considered an "engine compartment" inlet 220. The airflow 206 flows generally horizontally through the inlet 220 through the mesh 180 into the engine compartment 102.

The mesh 180 is part of a removable screen 181 which can be selectively placed across the inlet 220. The mesh 180 is held by a frame of the screen 181 which is bolted to the top wall 162 at the edge of the inlet 220. The mesh 180 can thus be easily replaced if necessary by removing the screen 181 and installing another screen 181. The openings of the mesh 180 are sufficiently large to allow airflow 206 therethrough but also sufficiently small to impede water contained in the airflow 206. The mesh is additionally treated with a hydrophobic coating or subjected to surface treatment, for example by being exposed to a chemical bath, in order to make it hydrophobic. The mesh 180 thus serves to remove water from the airflow 206 before the airflow 206 flows into the engine 20.

The mesh 180 of the illustrated embodiment is made of nylon fabric produced by Sefar® of Heiden, Switzerland. The fabric has a thickness of 100 microns and square mesh openings approximately 125 microns in length. Meshes 180 having a thickness other than 100 microns and openings having sides of lengths larger or smaller than 125 microns are also contemplated. In another embodiment, the mesh 180 is constructed of a polyester fabric having a thickness of 63 microns and square openings having sides of 105 microns in length. It is contemplated that the mesh 180 could have openings with sides having a length in the range of 105 microns to 125 microns. It is contemplated that the mesh openings could have a shape other than square. It is contemplated that the mesh could be made of a suitable material other than nylon or polyester.

Water contained in the airflow 206 which is prevented from flowing through the inlet 220 instead flows downwards along the wall 176 through the horizontally oriented inlet 210 along the baffle 170 extending downwards therefrom. The water flows down the passage 230 into the water drain valve below the passage 230 and thereby out of the engine compartment 102 as described above.

Inside the engine compartment 102, a passage 250 is formed between the top of the engine 20 and the interior surface of the top wall 162 of the central upper portion 106 of the support structure 105. The passage 250 connects the inlet 220 with the throttle body inlet 70. The airflow 206 flows via the inlet 220, the passage 250, and the throttle body inlet 70 into the throttle body 62 of the engine 20. The airflow 206 flowing into the throttle body inlet 70 after passing through the mesh 180 is thus substantially devoid of water.

In addition, the distance between the engine compartment inlet 220 and the throttle body inlet 70 is shorter than the distance between the engine compartment inlet 240 and the throttle body inlet 70. Therefore, the airflow 206 flows a shorter distance inside the engine compartment 102 than the distance traveled by the airflow 204 along the circuitous path inside the engine compartment 102. As such, the airflow 206 spends less time in the engine compartment 102 and contacts fewer components of the engine 20 and power head which may be hot during operation of the engine 20. Air received in the throttle body 62 from the airflow 204 could thus be hotter than the air received from the airflow 206. Furthermore, the air received in the combustion chamber has sufficiently low water content for optimal engine performance as the mesh 180 is effective for removing water from the airflow 206. Providing both airflows 204 and 206 ensures that air entering the combustion chamber is not so hot as to significantly lower engine power output and sufficiently dry to prevent damage to the engine 20.

It is contemplated that, instead of or in addition to the mesh 180 positioned across the inlet 220, a mesh 180 could be placed at another location along the passage 250. The mesh could be oriented normal to the direction of airflow at that location, or at an acute angle thereto. The mesh 180 could be connected between the top of the engine 20 and the interior surface of the top wall 162. It is contemplated that a mesh 180 could be placed across the throttle body inlet 70 instead of or in addition to the mesh 180 across the inlet 220. It is contemplated that the airflow 206 could pass through multiple meshes 180 before entering the combustion chamber of the engine 20. Similar to the baffle 170 and water drain valve disposed therebelow, a baffle and/or a water drain valve could be positioned in proximity to the other mesh(es) 180 of the passage 250 or throttle body inlet 70 to provide a path for water separated from the air by the mesh(es) 180. The water thereby removed form the airflow 206 would be directed out of engine compartment 102

In the illustrated embodiment, a portion of the airflow 204 from the inlet 240 flows upwards and mixes with the airflow 206 in the passage 250 before flowing through the throttle body inlet 70 into the engine 20.

It is contemplated that the engine compartment 102 and the engine 20 could be configured such that the airflow 204 does not mix with the airflow 206 until after entering the engine 20. For example, the airflows 204, 206 could flow along distinct and separate paths and mix together only after flowing through the throttle body inlet 70. It is contemplated that the airflows 204 and 206 could enter the combustion chamber via different inlets of the engine 20.

In the illustrated embodiment, inlets 210, 220 are both fluidly communicating with a common inlet, specifically the main inlet 200, for receiving air from outside the outboard engine 10. The airflow 202 entering through the main inlet 200 divides into separate airflows 204 and 206 respectively flowing into the engine compartment 102 via separate inlet 210, 220 which are both connected to the main inlet 200. It will be appreciated that any air entering via the side apertures 125 will mix with the airflow 202 entering via the main air inlet 200 and combine with the airflows 204 or 206. For example, the main inlet 200 could be omitted and the inlet 210, 220 could be formed in different portions of the cowling 100. In this case, the airflow 204 through the inlet 210 would mix with the airflow 206 through the inlet 220 only after flowing into the engine compartment 102.

It is also contemplated that the outboard engine 10 could have multiple inlets 220 having water-repellant meshes 180 disposed thereacross. It is contemplated that the outboard engine 10 could have multiple inlets 210 and corresponding passages 230 directing airflows 204 along a plurality of circuitous paths from the inlet 210 to the engine 20.

It is contemplated that the air intake system including the inlets 200, 210, 220, 240 and passages 230, 250 could be incorporated into a conventional cowling that does not have a central support structure and a panel assembly. Conventional cowlings, as will be understood by a worker skilled in the art, have a main body defining the engine compartment and a removable top cover for accessing the engine housed therein.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A cowling for housing an outboard engine, the cowling comprising:

a plurality of walls defining at least in part an engine compartment;

a first engine compartment inlet in fluid communication with the engine compartment and being defined at least in part by at least one of the plurality of walls;

a hydrophobic mesh member disposed across the first engine compartment inlet, the mesh member being adapted to prevent at least a portion of a water content of a first airflow to the engine compartment flowing via the first engine compartment inlet from entering the engine compartment;

a second engine compartment inlet in fluid communication with the engine compartment and being defined at least in part by at least one of the plurality of walls; and a passage fluidly communicating with the second engine compartment inlet and thereby with the engine compartment, the passage being defined at least in part by at least one of the plurality of walls, the passage being adapted to conduct a second airflow toward the second engine compartment inlet from the passage, the second airflow flowing through the second engine compartment inlet to the engine compartment, the passage being adapted to conduct the second airflow into the engine compartment via a circuitous path having at least one bend to cause a reduction in a water content of the second airflow.

2. The cowling of claim 1, wherein the first engine compartment inlet is disposed in one of the plurality of walls of an upper portion of the cowling.

3. The cowling of claim 1, wherein the first engine compartment inlet is disposed in one of the plurality of walls of a rear portion of the cowling.

4. The cowling of claim 1, wherein at least a portion of the passage extends generally downwardly towards the second engine compartment inlet.

5. The cowling of claim 1, further comprising a baffle connected to at least one of the plurality of walls, the passage being defined at least in part by the baffle.

6. The cowling of claim 5, wherein the second engine compartment inlet is defined at least in part by the baffle.

7. The cowling of claim 5, wherein the first engine compartment inlet is defined at least in part by the baffle.

8. The cowling of claim 5, wherein a portion of the baffle extends downwardly from the mesh member and the first engine compartment inlet.

9. The cowling of claim 1, further comprising a main inlet defined at least in part by at least one of the plurality of walls, the at least one of the plurality of walls being an outer wall, the main inlet fluidly communicating with the first engine compartment inlet and the passage.

10. The cowling of claim 9, wherein:

the plurality of walls comprises a rear cover and a top cover extending forward of the rear cover; and the main inlet is defined between the rear cover and the top cover.

11. An outboard engine comprising:

an engine, the engine comprising:

at least one cylinder;

a combustion chamber defined by the at least one cylinder; and a throttle body having a throttle body inlet fluidly connected to the combustion chamber; and a cowling having a plurality of walls defining at least partly an engine compartment housing at least a portion of the engine, the cowling comprising:

a first engine compartment inlet defined at least in part by at least one of the plurality of walls;

a first passage fluidly communicating the first engine compartment inlet with the combustion chamber and being defined at least in part by at least one of plurality of walls;

a hydrophobic mesh member being disposed in one of the first engine compartment inlet and the first passage, the mesh member being adapted to prevent at least a portion of a water content of a first airflow to the engine compartment via the first engine compartment inlet from entering the engine compartment;

a second engine compartment inlet defined at least in part by at least one of plurality of walls; and a second passage fluidly communicating with the second engine compartment inlet and being defined at least in part by at least one of plurality of walls, the second passage being adapted to conduct a second airflow toward the second engine compartment inlet from the second passage, the second passage being adapted to cause the second airflow to flow from the second engine compartment inlet via a circuitous path to the combustion chamber and to thereby cause a reduction of a water content of the second airflow.

12. The outboard engine of claim 11, wherein the hydrophobic mesh member is disposed in the first engine compartment inlet.

13. The outboard engine of claim 11, wherein the first passage fluidly communicates the first engine compartment inlet with the throttle body inlet.

14. The outboard engine of claim 11, wherein the first engine compartment inlet is at a level that is one of higher than and equal to a level of the throttle body inlet.

15. The outboard engine of claim 11, wherein at least a portion of the first passage is disposed between the engine and an upper portion of the cowling.

16. The outboard engine of claim 11, wherein the second engine compartment inlet is disposed lower than the throttle body inlet.

17. The outboard engine of claim 11, wherein the second engine compartment inlet is lower than the first engine compartment inlet.

18. The outboard engine of claim 11, further comprising a baffle connected to at least one of the plurality of walls, the second engine compartment inlet being defined at least in part by the baffle.

19. The outboard engine of claim 18, wherein the baffle extends downwardly from the first engine compartment inlet.

20. The outboard engine of claim 18, wherein the second passage is defined at least in part by the baffle.

21. The outboard engine of claim 11, wherein a distance between the first engine compartment inlet and the throttle body inlet is shorter in length than a distance between the second engine compartment inlet and the throttle body inlet.

* * * * *